United States Patent [19]

Peters

[11] 4,063,034

[45] Dec. 13, 1977

[54] AUDIO SYSTEM WITH ENHANCED SPATIAL EFFECT

[75] Inventor: Richard W. Peters, Algonquin, Ill.

[73] Assignee: Industrial Research Products, Inc., Elk Grove Village, Ill.

[21] Appl. No.: 684,640

[22] Filed: May 10, 1976

[51] Int. Cl.[2] ..... H04R 3/00

[52] U.S. Cl. ..... 179/1 J; 84/DIG. 26

[58] Field of Search ..... 179/1 J, 1 G, 1 GP; 84/DIG. 26, 1.24

[56] References Cited

U.S. PATENT DOCUMENTS

| | | | |
|---|---|---|---|
| 2,493,638 | 1/1950 | Olson | 179/1 J |
| 3,110,771 | 11/1963 | Logan et al. | 179/1 J |
| 3,217,080 | 11/1965 | Clark | 179/1 J |
| 3,333,061 | 7/1967 | Dow | 179/1 J |
| 3,478,167 | 11/1969 | Sorkin | 179/1 G |
| 3,681,531 | 8/1972 | Burkhard et al. | 179/1 J |
| 3,992,582 | 11/1976 | Osakabe | 179/1 J |

*Primary Examiner*—Douglas W. Olms

*Attorney, Agent, or Firm*—Kinzer, Plyer, Dorn & McEachran

[57] ABSTRACT

An audio system comprising a record player, tape deck, microphones, or other signal source which generates stereo signals supplied to two main speakers for reproduction; the stereo signals are added together to afford an intermediate signal which is subjected to at least two successive equal delays to generate a plurality of delayed signals which are summed with the intermediate signal in predetermined amplitude and phase relation to generate a spatial effect signal that is essentially free of noticeable reverberations or echoes. This spatial effect signal is reproduced by a separate speaker in the same listening space as the main speakers to add ambience and diffuseness to the total sound field. In the preferred construction two delayed signals are employed, delay is effected with the signals in digital form, and the summing ratio for the intermediate, first delayed, and second delayed signals is approximately 1:2:1 with the intermediate signal and the second delayed signal in phase opposition. A corresponding monophonic system is also disclosed.

18 Claims, 9 Drawing Figures

Fig. 1.
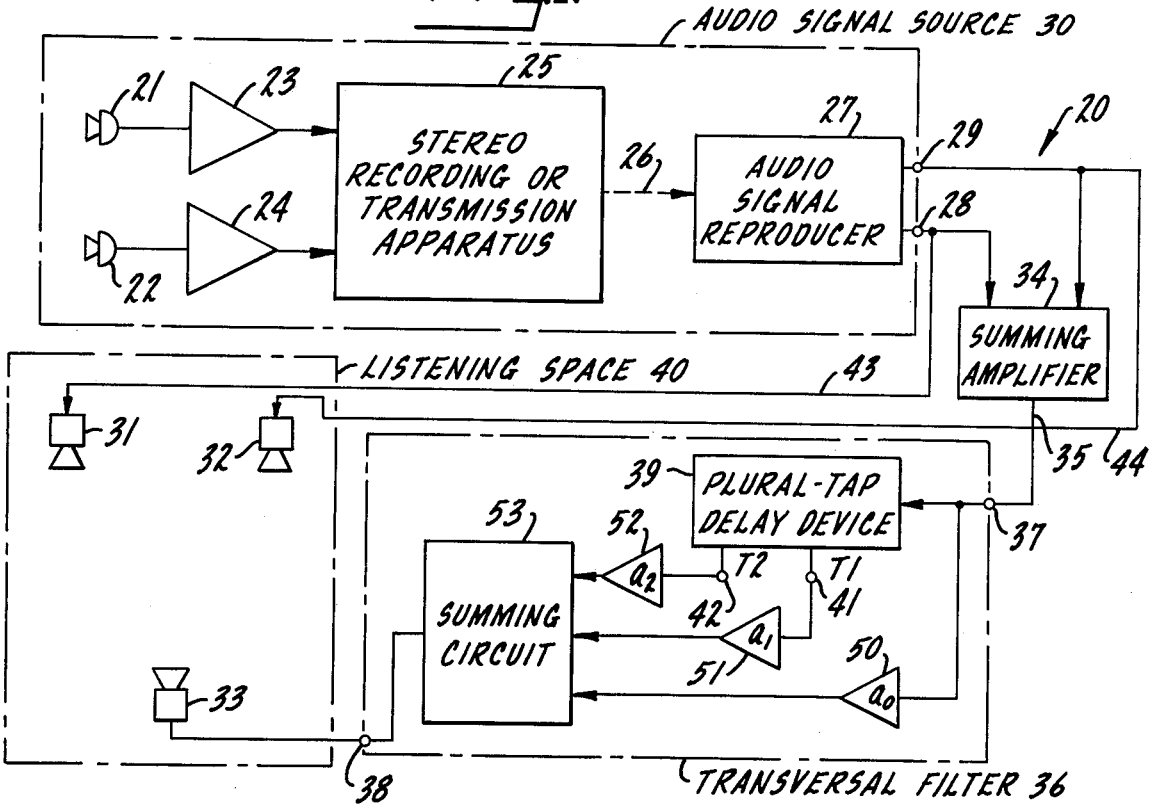
Fig. 2.
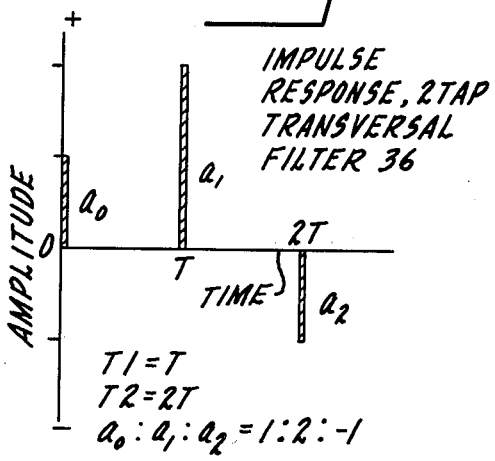
Fig. 4.
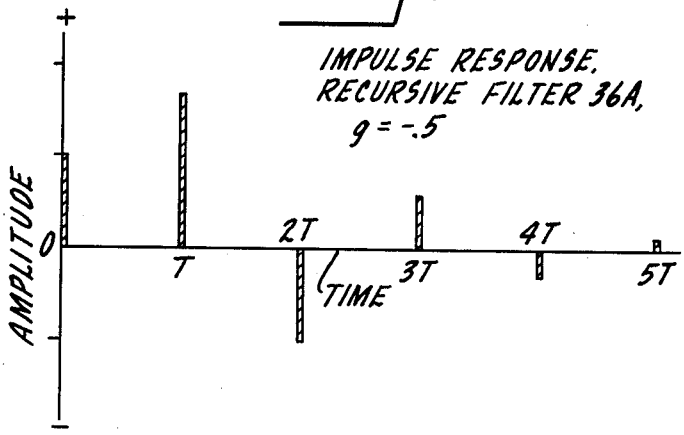
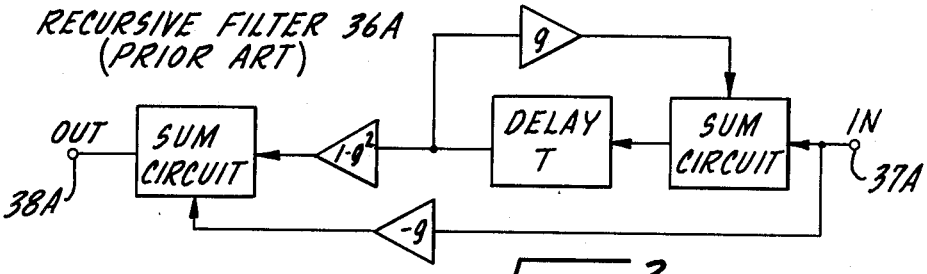
Fig. 3.

DELAY MEANS 39
IN
35
COMPRESSOR
61
ANALOG TO DIGITAL CONVERTOR (DELTA MOD.)
62
SHIFT REGISTER
63
T
71
2T
72
64
CLOCK
DIGITAL-ANALOG CONV.
73
DIGITAL-ANALOG CONV.
74
EXPANDER
75
EXPANDER
76
41
42
TRANSVERSAL FILTER 36
$a_2=-1$
52
$a_1=2$
51
$a_0=1$
50
38
OUT
SUMMING AMPLIFIER 53
ALL IC'S LM 741C
ALL RESISTORS, 10K
ALL CAPACITORS, 0.47μf 121
123
125
RECORDING OR TRANSMISSION APPARATUS
126A
127
AUDIO SIGNAL REPRODUCER
136
TRANSVERSAL FILTER
126B
135
128

120
133
131
LISTENING SPACE 140

AUDIO SYSTEM WITH ENHANCED SPATIAL EFFECT

BACKGROUND OF THE INVENTION

This invention relates to an audio system that effectively adds an ambience or diffuseness to the sound field generated within a given listening space, thereby increasing the apparent size or spaciousness of the listening space. This spatial effect is obtained by utilizing at least one additional speaker or other sound radiator, over and above the primary speakers employed to reproduce music or other sound effects within the listening space. The spatial effect signal employed to drive the additional speaker is developed by a transversal filter that effectively scales, delays, and recombines the original signal.

In music reproduction in the home, the performance of either a monophonic or a stereophonic audio system is frequently unsatisfactory in that the sound effects normally produced in a concert hall or like listening space are not effectively reproduced. This is particularly true for musical performances reproduced from phonograph records, tapes, radio broadcasts, or other sources. Somewhat similar problems are also encountered in outdoor concert areas and in large auditoria, where the overall effect of a local musical performance is not as pleasing as in a small concert hall or like facility with good acoustic characteristics. Multipurpose auditoria and other large halls are frequently designed for speech and require artificial sound enhancement for improvement of musical productions.

One technique that has been used to compensate for a lack of spatial effect comprises the addition of one or more auxiliary speakers, to which the primary audio signal is supplied with some delay. If the delay is substantial, however, distinct and objectionable echoes are heard by many listeners, particularly for transient sounds. Reducing the delay, on the other hand, minimizes the spatial effect, often to the point at which little or no improvement is achieved.

Another known arrangement for introducing spatial effects in an audio system comprises the use of an additional speaker, driven by an audio signal translated through a filter that employs both delay and feedback. In its simplest form, the output of a delay device is attenuated and fed back to the input, at less than unity gain, affording an output signal having an impulse response which comprises an indefinite series of evenly spaced pulses of progressively decaying amplitude. Such feedback filters are referred to in this specification as "recursive filters". When employed for enhanced spatial effect, recursive filters present substantial problems of poor frequency response, obtrusive echoes, and directional distortion.

An improvement on the simple recursive filter is described in Logan et al. U.S. Pat. No. 3,110,771, in which the recursive filter is combined with an undelayed transmission channel, utilizing specific gain relationships in both the delayed and undelayed channels of the filter. This recursive filter circuit can be constructed to have a flat frequency response, and produces enhanced spatial effects through the addition to the filter output of a specific amount of the original undelayed audio signal. However, this kind of recursive filter produces a highly peaked delay-frequency characteristic in many instances, and tends to produce a barrel-like sound due to an evenly spaced repetition of the signal with time, extending for a substantial period after termination of the primary audio signal. That is, the indefinite continuation of impulse response, using a recursive filter, even of this improved kind, affords a continuation effect that is frequently objectionable and may distort perception of the direction of origin of the sound.

Transversal filters have occasionally been utilized to generate spatial effect signals used to enhance the ambience and diffuseness of sound within a given listening space. A transversal filter has a finite impulse response, as contrasted with the indefinite impulse response to a recursive filter, so that some of the echo or continuation effects of recursive filters are not presented. Transversal filters, however, have also exhibited serious shortcomings and faults in sound quality. Thus, spatial effect audio systems employing transversal filters, as known in the art, have usually exhibited frequency responses with high peaks and dips, resulting in poor sound quality. Another fault of these systems has been the production of perceptible individual echoes, again resulting in degradation of the reproduced sound.

These problems result from inexact methods of choosing the delay values, scaling values, and proper combinations of the signals. The present invention is based in part upon the discovery that quite specific values of delay, scale, and combination are required to produce a uniform frequency response and improved spatial effects when employing a transversal filter. In attempting to overcome these problems, more complex filters with greater numbers of delay intervals have been employed, as have parallel combinations of such filters. Some degree of improvement can be obtained by these techniques, but complexity and cost are high.

SUMMARY OF THE INVENTION

An object of this invention, therefore, is to provide a new and improved audio system with enhanced spatial effect that minimizes or eliminates the problems of the prior art and that affords enhanced ambience or diffuseness of the sound field within a listening space, with increased sense of spaciousness, ulitizing a transversal filter in developing a spatial effect signal.

Another object of the invention is to provide a new and improved audio system that utilizes a transversal filter in the generation of a spatial effect signal and that affords a subjectively flat frequency response with no appreciable continuation effect or perceptible echoes.

A further object of the invention is to provide a new and improved audio system, using a transversal filter as a source of a spatial effect signal, in which the sense of direction or location of the audio source is effectively maintained.

A particular object of the invention is to provide a new and improved audio system having enhanced spatial effects, utilizing a transversal filter as the principal component in generating a spatial effect signal, that is applicable to monophonic or stereophonic operation and that is simple and economical in construction, yet affords a relatively flat amplitude-frequency characteristic over a broad band of frequencies and a delay-frequency characteristic with essentially uniform delay distribution and small frequency spacing.

Accordingly, the invention relates to an audio system comprising an audio signal source for developing a primary audio signal; a primary audio transducer and a secondary audio transducer positioned within a listening space, primary transmission means, coupling the audio signal source to the primary transducer, for applying the primary audio signal to the primary transducer for reproduction, and secondary transmission means, coupling the audio signal source to the secondary transducer, for developing a spatial effect audio signal and applying the spatial effect audio signal to the secondary transducer for reproduction. The secondary transmission means comprises non-recursive transversal filter means having a finite impulse response, including delay means for developing first and second delayed audio signals each corresponding to the primary audio signal but delayed by fixed delay intervals T1 and T2, respectively, with T2>T1, and summing circuit means for additively combining the delayed audio signals and the primary audio signal in predetermined amplitude ratio and predetermined phase relationship to develop a spatial effect audio signal having a relatively flat amplitude-frequency characteristic over a broad band of frequencies and a delay-frequency characteristic with relatively uniform delay distribution and small frequency spacing. In the preferred construction, T2 = 2T1, T1 is of the order of 30 msec., and the gain ratio for the primary, first delayed, and second delayed signals as combined in the summing circuit means is 1:2:−1 or −1:2:1. For stereo systems, the input signal to the secondary transmission means is an intermediate signal developed by combining two stereo inputs, or the two stereo signals may be processed separately.

BRIEF DESCRIPTION OF THE DRAWINGS

FIG. 1 is a block diagram of a stereo audio system constructed in accordance with one embodiment of the present invention;

FIG. 2 is a graphical representation of the impulse response of the transversal filter in the audio system of FIG. 1;

FIG. 3 is a block diagram of a recursive filter employed in previously known audio systems;

FIG. 4 is a graphical representation of the impulse response for the filter of FIG. 3;

DESCRIPTION OF THE PREFERRED EMBODIMENTS

Figure 5:
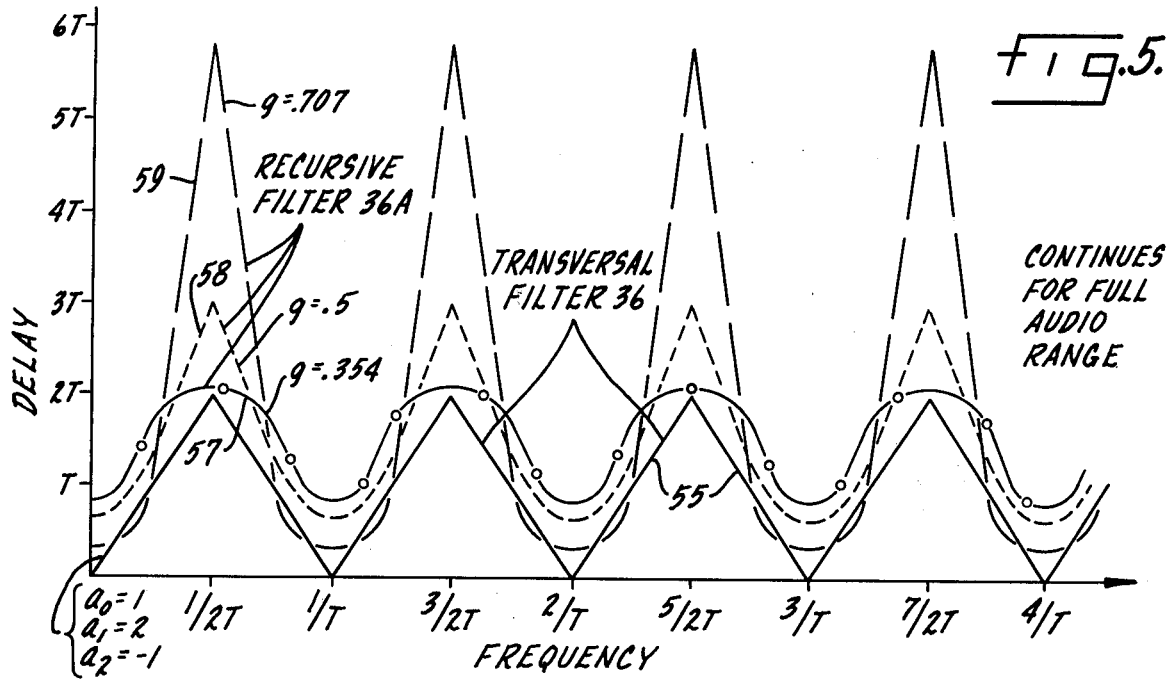
FIG. 5 is a graph illustrating the delay-frequency characteristics of the transversal filter of FIG. 1 and the recursive filter of FIG. 3.

FIG. 1 illustrates a stereophonic audio system 20 utilizing first and second primary audio signals from an audio signal source 30, that is effective to produce added ambience or diffuseness in the sound field developed within a listening space 40. As illustrated, the audio signal source 30 may comprise two microphones 21 and 22 coupled to a stereo recording or transmission apparatus 25 by suitable amplifiers 23 and 24. Apparatus 25 is intended to afford a general representation of conventional stereo recording equipment for producing stereo phonograph records, tapes, or the like. On the other hand, in a given instance, apparatus 25 may comprise radio transmission equipment for radiating the signals necessary for stereo reproduction at a remote location. Source 30 further comprises an audio signal reproducer 27 linked to apparatus 25 as generally indicated by the dash line 26. For a radio system, the dash line 26 may represent the transmission medium. Alternatively, it may be considered to represent the physical transmission of phonograph records or stereo tapes from the location of apparatus 25 to the location of reproducer 27, which in this instance may comprise a conventional tape deck, record player, or other reproduction equipment.

The output of audio signal source 30, appearing at its output terminals 28 and 29, comprises first and second primary audio signals which are stereophonically related to each other. System 20 includes two lines 43 and 44 which connect terminals 28 and 29 to two primary speakers or other transducers 31 and 32, respectively, speakers 31 and 32 being positioned in spaced relation to each other at one end of listening space 40. Thus, lines 43 and 44 afford a primary transmission means that couples audio signal source 30 to primary transducers 31 and 32, applying a first primary audio signal from terminal 28 to the first primary transducer 31 for reproduction and applying a second primary audio signal from terminal 29 to the second primary transducer 32 for reproduction.

System 20 further comprises secondary transmission means coupling signal source 30 to a secondary transducer, a speaker 33, that is also located in listening space 40, preferably at the opposite end of the listening space from primary transducers 31 and 32. This secondary transmission means develops a spatial effect audio signal that is applied to speaker 33 for reproduction to afford an enhanced ambience or diffuseness for the sound field developed within space 40.

In stereo system 20, the secondary transmission means comprises a summing amplifier 34 having two inputs, each connected to one of the output terminals 28 and 29 of audio signal source 30. Amplifier 34 additively combines the primary stereo signals from source 30 in equal ratio, developing a monophonic intermediate audio signal at its output 35 that is representative of the entire program content of the two stereo signals from source 30. The output 35 of summing amplifier 34 is connected to the input terminal 37 of a transversal filter 36, filter 36 having an output terminal 38 that is connected to transducer 33.

Filter 36 is a non-recursive transversal filter having a finite impulse response. It includes delay means for developing first and second delayed audio signals, each corresponding to the intermediate audio signal supplied to filter 36 at input terminal 37 but delayed by successively larger fixed delay intervals. Thus, filter 36 comprises a plural-tap delay device 39, to which the intermediate audio signal from terminal 37 is applied. Delay device 39 has two taps 41 and 42, the signal at tap 41 being delayed by an interval T1 and the signal at tap 42 being delayed by a total time T2. The time delay T1 for the first delayed audio signal at tap 41 is in a range of 5 milliseconds to 80 milliseconds; preferably, delay interval T1 is approximately 30 msec. The delay T2 for the second delayed audio signal developed at tap 42 of delay device 39 is preferably twice the delay interval T1.

Transversal filter 36 further comprises a summing circuit 53 for additively combining the delayed audio signals from taps 41 and 42 with the undelayed intermediate audio signal supplied to filter 36 at its input terminal 37. The input connection to summing circuit 53 from terminal 37 includes an amplifier 50 having a gain $a_o$. The circuit connecting tap 41 of delay device 39 to the input of summing circuit 53 includes an amplifier 51 having a gain $a_1$; the circuit from tap 42 to summing circuit 53 includes an amplifier 52 having a gain $a_2$. In the preferred construction for transversal filter 36, the gain ratio $a_o:a_1:a_2$ of the amplifiers 50, 51 and 52 has a ratio of absolute values of approximately 1:2:1, with the phase of the second delayed audio signal from tap 42 being reversed relative to the phase of the intermediate audio signal from input terminal 37. That is, the sign of the gain multiplier $a_o$ is reversed as compared with the sign of $a_2$. For the succeeding discussion, and particularly the graphs of FIGS. 2 and 5, it is assumed that $a_o$ is of the same sign as $a_1$ and that $a_2$ is of the opposite sign so that the actual gain ratio is 1:1:−1. Alternatively, the gain ratio could be 1:−2:−1.

In reviewing the operation of audio system 20, it may first be considered that transversal filter 36 is omitted and that the spatial effect speaker 33 receives the monophonic output signal directly from summing amplifier 34. In this arrangement, a very slight improvement is achieved in the spaciousness of the sound field developed within listening space 40, but the directional dominance and the stereophonic effects of the sound radiated from the primary speakers 31 and 32 are both diminished, particularly for listeners positioned closer to speaker 33 than to speakers 31 and 32. Expanding the system with additional spatial effect speakers could increase the apparent spaciousness of the sound, but at a further sacrifice of the directional and stereophonic effects.

Next, it is useful to consider the operation of system 20 with a conventional delay circuit substituted for transversal filter 36. By supplying the monophonic signal from summing amplifier 34 to speaker 33 with only a limited delay modification, speakers 31 and 32 generally retain control of directional perception with little or no sacrifice of stereophonic impressions, due to what is known as the precedence effect. Thus, it has been demonstrated that the first arriving sound is interpreted by a listener as indicating the direction of the source of that sound. In addition to maintaining precedence of the primary stereophonic speakers 31 and 32, the delayed sound developed by speaker 33 is interpreted by the listener as an echo, so that an increase in spatial sense is perceived. However, if the delay exceeds approximately 20–25 milliseconds, distinct and objectionable echoes may be apparent to many listeners, particularly for transient sounds. Reducing the delay eliminates these perceptible echoes but also greatly diminishes the spatial effect. If additional spatial effect speakers supplied with signals of different delay values are added to the system, a fill-in of echoes can be achieved to afford a smooth sound, but this is accomplished only with substantially increased complexity and cost.

One of the principles upon which the present invention is based is that the signal to the spatial effect speaker 33 must be delayed differently for different frequencies. This is achieved in system 20 by transversal filter 36, which is constructed to afford a periodic delay-frequency characteristic. As shown by curve 55 in FIG. 5, illustrating the delay-frequency characteristic for the output signal from transversal filter 36, the spatial effect signal supplied to speaker 33 exhibits different delays for different frequencies, throughout the entire range of frequencies utilized by the speaker. Consequently, in system 20 the sound from speaker 33 does not cause perceptible echoes within listening space 40 even though the average delay may well exceed, and preferably should exceed, the aforementioned critical level of 20–25 msec.

In system 20, because the sound from the secondary transducer 33 is delayed, transducers 31 and 32 retain precedence, in the perception of the listener, so that directional and stereophonic effects are maintained. Because speaker 33 produces delayed sounds for which the delay exceeds 25 msec, spatial effects are enhanced. Moreover, transversal filter 36 affords not only the desired delay-frequency periodicity and uniformity of distribution, but also has an all-pass characteristic constituting a subjectively flat frequency response with a quite limited ripple, as shown by curve 56 in FIG. 6.

Probably the most effective recursive filter that might be substituted for transversal filter 36, in audio system 20, is the filter 36A, having input and output terminals 37A and 38A, that is illustrated in FIG. 3. Filter 36A corresponds in all respects to the reverberator circuit shown in FIG. 3A of Logan et al U.S. Pat. No. 3,110,771, so that a detailed description of its operation is deemed unnecessary. If filter 36A is substituted for filter 36 in system 20, FIG. 1, a flat frequency response is obtained and a spatial effect is also achieved. However, the overall effect is not the same and lacks several of the advantages of transversal filter 36.

Thus, with recursive filter 36A incorporated in system 20 instead of the non-recursive transversal filter 36, the impulse response of the spatial effect channel is markedly different. As shown in FIG. 2, the impulse response for transversal filter 36 ends completely at time 2T, corresponding to the time delay interval T2 for the second tap 42 of delay device 39. In contrast, the impulse response for recursive filter 36A, shown in FIG. 4, constitutes an indefinite series of impulses, theoretically an infinite series. The indefinite series of echoes produced by the recursive filter 36A affords undesirable reverberation effects that continue after sounds from the primary speakers 31 and 32 have ceased. This can result in an apparent shift of the sound source from one end to the other of listening space 40 at the ending of musical passages or when other similar interruptions in the sound program occur, however brief.

The overall ratio of the delayed secondary signal to speaker 33 relative to the primary signals supplied to speakers 31 and 32 is somewhat higher for transversal filter 36 than for recursive filter 36A (compare FIGS. 2 and 4). This affords added spaciousness in the overall sound field within listening space 40, when employing the transversal filter of the present invention, without the increased reverberation that is produced by the recursive filter of FIG. 3. Furthermore, the recursive filter produces sounds that have a greater "barrel" effect, due to evenly spaced indefinite repetition of the signal with time (FIG. 4); in contrast, transversal filter 36 terminates the spatial effect signal to speaker 33 after a fixed time delay (2T) and sounds less altered in quality.

The differences in the delay-frequency chracteristics of the transversal filter 36 and recursive filter 36A are graphically illustrated in FIG. 5. As shown therein, the delay-frequency characteristic of transversal filter 36 is of essentially triangular configuration, with zero delay as a minimum, affording an even; uniform distribution of delay throughout the frequency spectrum. Depending upon the gain value $g$ selected for recursive filter 36A, on the other hand, that circuit presents sharply peaked delay-frequency characteristics or a generally sinusoidal characteristic, as shown by curves 57, 58 and 59 for gain multipliers of $g = 0.354$, $g - 0.5$, and $g = 0.707$ respectively. The uniform distribution of delay afforded by transversal filter 36, curve 55, is not achieved by recursive filter 36A, curves 57–59. Furthermore, the recursive filter 36A cannot provide zero delay at any frequency, as is apparent from curves 57–59.

Figure 5A:
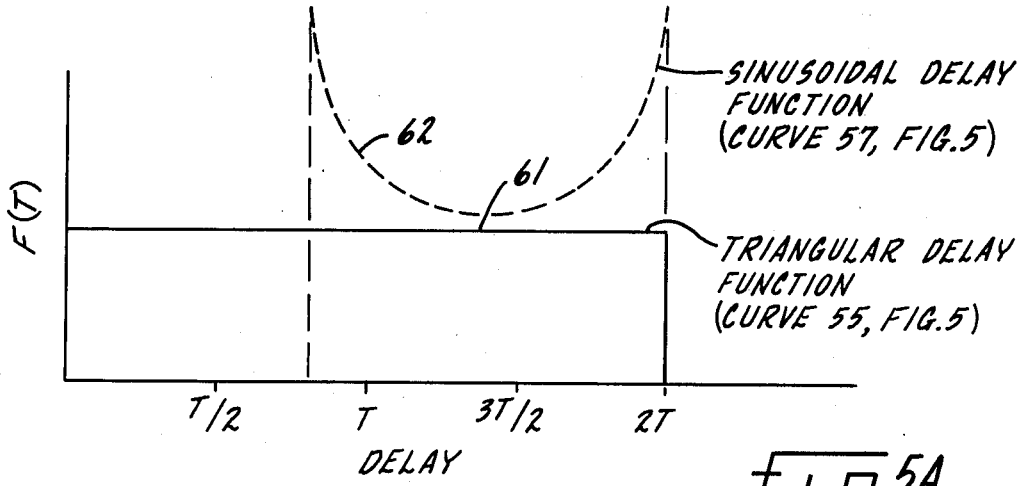
FIG. 5A is a graphic illustration of delay distribution for the two kinds of filters.

Another illustration of this operational difference is afforded in FIG. 5A, in which the function F(T) corresponding to the fraction of the system band width having a delay value between the minimum and maximum delays is plotted as a function of delay. In FIG. 5A, curve 61 illustrates the uniform distribution of delay afforded by transversal filter 36, whereas curve 62 is a corresponding plot based on recursive filter 36A with a gain $g = 0.354$. The uniform delay distribution afforded by filter 36 is quite advantageous in avoiding perceptible echoes and other undesirable effects.

In determining the construction to be used for transversal filter 36, and particularly the selection of the delay intervals T1 and T2 for taps 41 and 42, several factors should be taken into account. As shown in FIG. 5, in which T is the time delay T1 for tap 41 and T2 = 2T, peak delays occur at frequencies constituting odd integral multiples of 1/2T. If these delay function peaks are widely spaced in frequency (e.g. 1000 Hz) then sound having a bandwidth smaller than the spacing would all be delayed by the same amount and quite perceptible echoes could be created. However, if the peak spacing is small (e.g., less than 50 Hz) then most sounds are composed of frequencies extending over many periods of the delay-frequency function and perceptible echoes are not produced. The shape of the delay-frequency function also enters into this effect, particularly at low frequencies where sounds may occupy only one or two periods of the delay-frequency characteristic. The triangular configuration of the delay-frequency characteristic afforded by transversal filter 36, illustrated by curve 55 in FIG. 5, distributes the delay substantially better than either a square wave function or the sinusoidal or the peaked or generally sinusoidal functions afforded by recursive filter 36A, curves 57–59.

Figure 6:
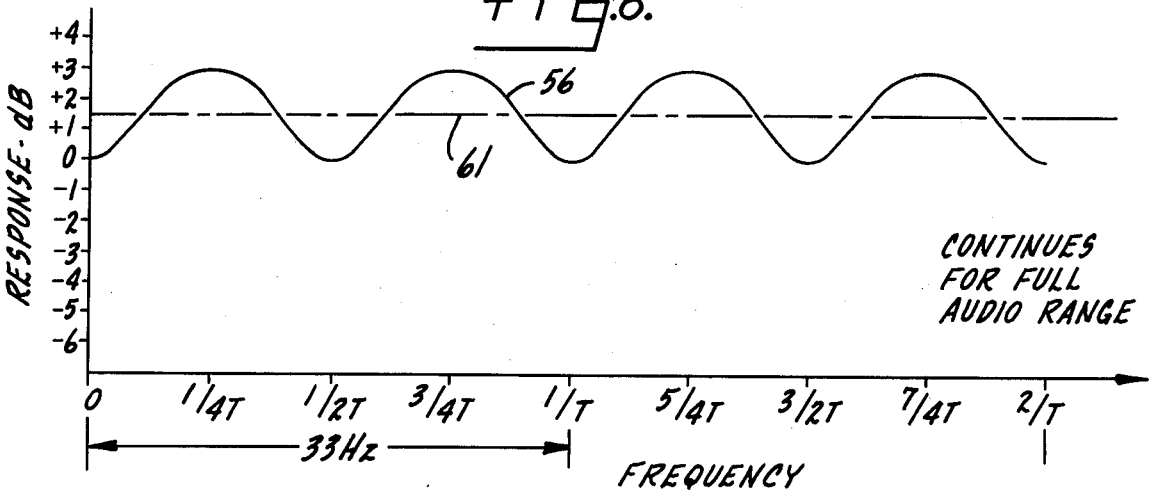
FIG. 6 is a graph illustrating the amplitude-frequency characteristics of the two kinds of filters.

As shown in FIG. 6, line 61, the amplitude-frequency characteristic for recursive filter 36A is essentially flat. As shown in the same figure, by curve 56, the amplitude-frequency characteristic for transversal filter 36 is also essentially flat but has a small ripple, approximately ±1.5 db.

The transversal filter 36 (FIG. 1) can be generalized as a filter having N+1 taps. For this general filter construction, the impulse response is:

$$h(T) = \sum_{n=0}^{N} a_n \delta (t - T_n) \tag{1}$$

in which $\delta$ is the Dirac function. Frequency response is $$H(w) = \sum_{n=0}^{N} a_n e^{-iwTn} \tag{2}$$

In general, the tap spacing for delay device 39 can be made uniform, in terms of delay interval between taps, without loss of filter synthesis capability, greatly simplifying analysis. Thus, assuming evenly spaced taps, $$T_n = nT \tag{3}$$

hence $$TO = O;\ T1 = T,\ T2 = 2T,\ T3 = 3T, \ldots \tag{4}$$

On this basis, the impulse response becomes:

$$h(T) = \sum_{n=0}^{N} a_n \delta (t - nT) \tag{5}$$

and the frequency response becomes $$H(w) = \sum_{n=0}^{N} a_n e^{-iwnT} \tag{6}$$

The primary design functions are the absolute value of the frequency response, which may be expressed as $$|H(w)|^2 = \sum_{k=0}^{N} \sum_{n=0}^{N} a_n a_k \cos (n - k) wT \tag{7}$$

and the delay-frequency function $$\text{delay} = -\frac{d\theta}{dw} = \frac{T \sum_{k=0}^{N} \sum_{n=0}^{N} n a_n a_k \cos(n - k) wT}{|H(w)|^2} \tag{8}$$

in which $\theta$ is phase.

On the basis of the foregoing analysis, the design of transversal filter 36, for the generalized case postulated above, is reduced to the determination of the values of terms $a_o$ through $a_n$ (the gain multipliers for the amplifiers such as amplifiers 51 and 52, FIG. 1) in Equations (7) and (8) that provide a reasonably flat frequency response and a delay-frequency characteristic with good delay distribution and acceptably small frequency spacing period. Of course, the fewer the taps required to produce these desired results, the more economical the construction of transversal filter 36.

For N=1, using only a single delay in combination with an undelayed audio signal, the ratio of the coefficients $a_o$ and $a_1$ must be maintained quite small in order to have an acceptably flat frequency response. But if $a_1$ is small, very little delay is introduced, whereas if $a_o$ is small, echo effects occur. That is, either the signal supplied to the spatial effect transducer 33 is not appreciably delayed ($a_1$ small) or virtually all of the signal is delayed ($a_o$ small). Adequate solutions with this single delay version of the transversal filter are virtually impossible.

For N=2, however, a quite effective solution can be reached. FIGS. 5 and 6 show the results for $a_o = 1$, $a_1 = 2$, and $a_2 = -1$. The frequency response 56 (FIG. 6) is flat to within plus or minus 1.5 db and the delay response 55 (FIG. 5) is smoothly distributed. For T = 30 msec., the maximum delay is 60 msec for some frequencies. The repetition bandwidth, constituting the spacing between peaks in curve 55 is 33 Hz, which is small enough for good delay mixing of musical sounds. Some limited modification of this gain ratio is permissible, but major changes produce undesirable results.

Curve 55 is slightly idealized as compared with actual measurements, but the performance of the two-tap transversal filter illustrated in FIG. 1 adheres quite closely to the ideal triangular configuration desired for a uniform delay distribution. The frequency response (curve 56, FIG. 6) can be further flattened and slightly more uniform delay distribution can be effected by further increasing the number of taps (e.g., N = 3 or N = 4), the improvement realized is not of major significance and is usually not worth the additional expense. By constructing the individual amplifiers such as amplifiers 51 and 52 as frequency-dependent circuits, the delay and frequency response functions can be made to vary with differing frequencies, but this modification constitutes a special effect not ordinarily necessary or desirable for improvement of musical renditions.

The delay function performed by device 39 (FIG. 1) can be carried out by a variety of different circuits and apparatus. For example, a digital delay system can be employed, using the basic delay apparatus and other circuits from U.S. Pat. No. 3,681,531 as discussed more fully in connection with FIG. 7. Other delay devices that can be used for circuit 39 include a tape recorder with two or more spaced playback heads or analog shift registers of either the charge-coupled or bucket brigade types.

The specific example described above for transversal filter 36 uses a basic delay interval T of 30 msec., affording a maximum delay of 60 msec. It has been found that increase of this delay by a factor of two still avoids perceptible echoes and provides some additional enhancement of spatial effects. The example given was chosen as representing a pleasant spatial effect beyond which the sound becomes somewhat more reverberant.

Figure 7:
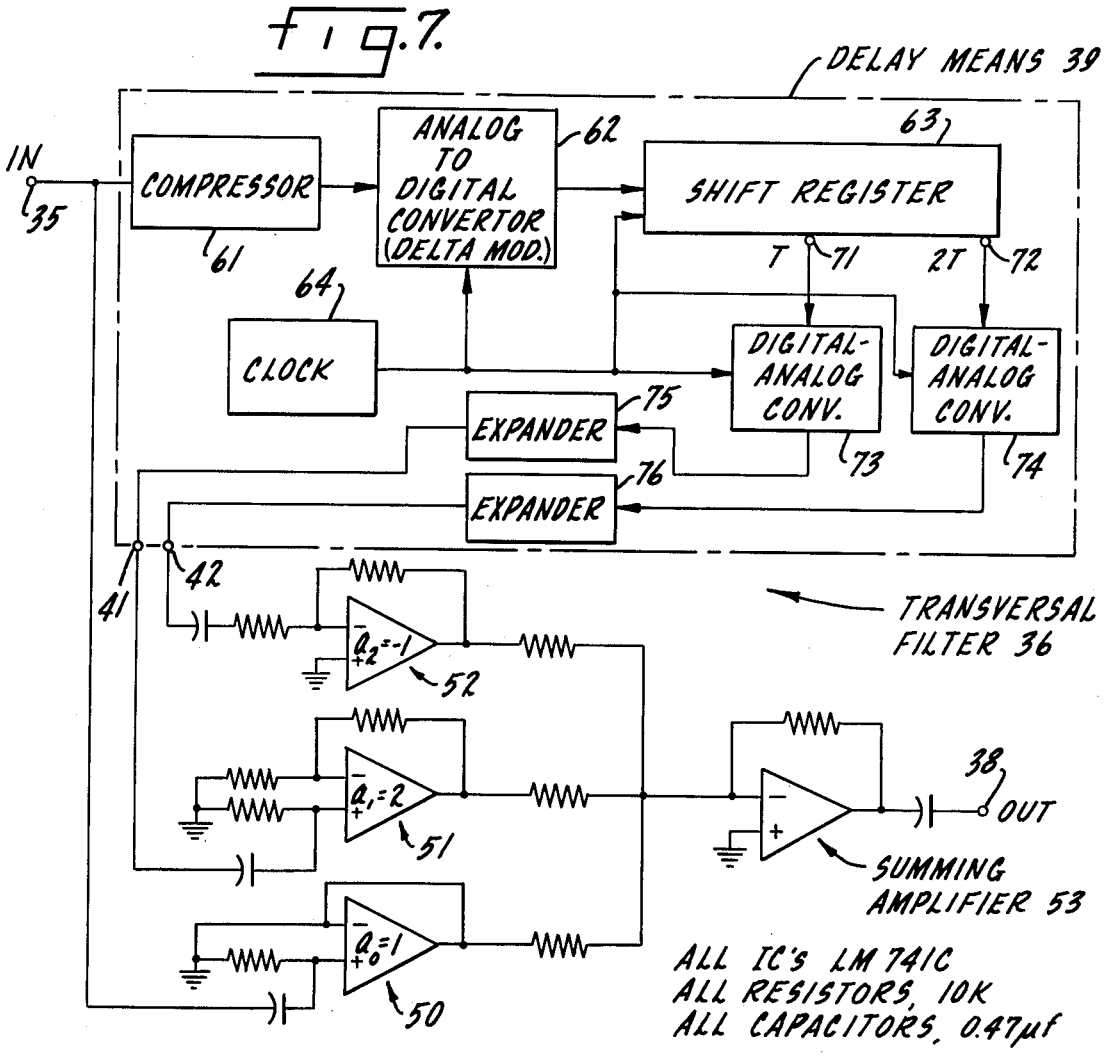
FIG. 7 is the block diagram and schematic circuit diagram of a preferred embodiment of the transversal filter used in the present invention.

FIG. 7 illustrates a preferred construction for transversal filter 36. In that preferred construction, the input terminal 35 for the filter is connected to a compressor circuit 61 having its output coupled to an analog-digital converter 62. Converter 62 could comprise a pulse code modulation circuit or other form of analog-digital converter; preferably, however, it constitutes a delta modulator of the kind described in U.S. Pat. No. 3,855,555. The digital output signal from converter 62 is supplied to the input of a conventional shift register 63 having two taps 71 and 72; the delay interval at tap 71 is the time T and at tap 72 is 2T. Timing of the operation of delta modulator 62 and shift register 63 is controlled by a suitable clock signal from a clock circuit 64.

The digital audio signal available at tap 71 of shift register 63 is applied to a digital-analog converter 73 that also receives a timing input from clock 64. The analog signal developed in converter 73 is coupled to the output terminal 41 of delay device 39 through a circuit that includes an expander 75. Similarly, the digital audio signal available at shift register tap 72 is converted to analog form in a digital-analog converter 74, expanded in a circuit 76, and appears at the delay device output terminal 42.

The particular construction for delay device 39 that is illustrated in FIG. 7 provides a convenient and inexpensive circuit for achieving the necessary delays of the intermediate audio signal supplied to terminal 35 while maintaining high quality in the delay signals that are developed at output terminals 41 and 42. The complementary compression and expansion of the signals afforded by compressor 61 and expanders 75 and 76 effectively minimizes the creation of noise in the output signals at terminals 41 and 42 caused by the analog-digital and digital-analog conversions in delay device 39. Shift register 63 affords an inexpensive yet accurate basic delay circuit.

FIG. 7 also shows specific scaling and combining circuits for filter 36, comprising individual amplifiers 50, 51 and 52 and summing amplifier 53. Each of these amplifiers is based upon a type LM741C integrated circuit amplifier. All of the illustrated resistors are of a value of 10 kilohms and each of the capacitors has a value of 0.47 microfarads. The illustrated amplifier circuits afford the requisite gains $a_o a_1$ and $a_2$ and provide the desired delay-frequency and amplitude-frequency characteristics discussed above in connection with FIGS. 5–6.

Figure 8:
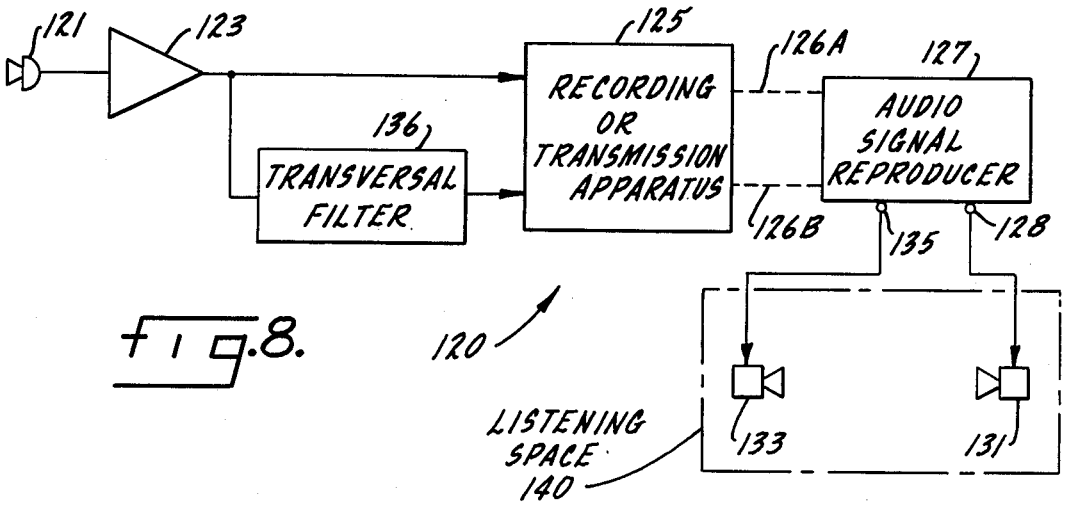
FIG. 8 is a block diagram of a monophonic audio system constructed in accordance with another embodiment of the invention.

FIG. 8 affords a block diagram of a monophonic audio system 120 that represents another embodiment of the present invention, in which the position of the transversal filter in the overall system is changed. System 120 comprises a microphone coupled to an amplifier 123 which is in turn connected to the output of a recording or transmission apparatus 125. In this system, however, the transversal filter 136 for generating the spatial effect audio signal has its input connected to the output of amplifier 123 so that the spatial effect audio signal comprising the output of filter 136 is supplied to the recording or transmission apparatus 125. In this sytem, therefore, the primary audio signal from amplifier 123 is recorded or transmitted to an audio signal reproducer 127 (phonograph, tape deck, or radio) along one transmission path 126A and the spatial effect audio signal is supplied to reproducer 127 along another transmission path 126B. Thus, in system 120, the effective audio source feeding the transversal filter comprises microphone 121 and amplifier 123.

Audio reproducer 127 has a main output terminal 128 at which the primary audio signal is developed, terminal 128 being connected to a primary transducer comprising a speaker 131 located within a listening space 140. The spatial effect audio signal from transversal filter 136, as reproduced in circuit 127, appears at output terminal 135 which is connected to a secondary transducer in space 140, the speaker 133. The construction of transversal filter 136, as incorporated in system 120, follows the same design considerations and may be essentially identical to transversal filter 136 as described in detail above. Furthermore, system 120 produces the same result or added spaciousness in the overall sound field within listening space 140 as is provided by system 20 (FIG. 1). Of course, it will be recognized that the change of position of the transversal filter in system 120 (FIG. 8) as compared with system 20 (FIG. 1) can be applied to a stereo system as well as to the monophonic system. Furthermore, a stereo system can readily be constructed, incorporating two spatial effect speakers instead of one, by simply utilizing two systems like monophonic system 120, with the transversal filter in the position illustrated in FIG. 7 or in the position shown in FIG. 1.

In the foregoing description, it has been assumed that there is essentially zero delay between the signal supplied to the transversal filters and the primary speakers. However, some overall delay can be permitted in the spatial effect channel, sometimes with quite pleasing effects. When this arrangement is adopted, of course, time "0" for the spatial effect channel occurs after the corresponding time for the same signal content in the main channel.

I claim:

1. An audio system comprising:

an audio signal source for developing a primary audio signal;

a primary audio transducer and a secondary audio transducer positioned within a listening space;

primary transmission means, coupling the audio signal source to the primary transducer, for applying the primary audio signal to the primary transducer for reproduction;

and secondary transmission means, coupling the audio signal source to the secondary transducer, for developing a spatial effect audio signal and applying the spatial effect audio signal to the secondary transducer for reproduction, the secondary transmission means comprising non-recursive transversal filter means having a finite impulse response, including:

delay means for developing a series of at least two delayed audio signals each corresponding to the primary audio signal but each delayed by a successively longer fixed delay interval with the delay interval for the first signal in the series and the delay spacing between successive signals in the series being of uniform duration, and summing circuit means for additively combining the delayed audio signals and the primary audio signal in predetermined amplitude ratio and predetermined phase relationship to develop a spatial effect audio signal having a relatively flat amplitude-frequency characteristic over a broad band of frequencies and a delay-frequency characteristic with relatively uniform delay distribution and small frequency spacing.

2. An audio system according to claim 1 in which the delay interval for the first delayed audio signal and the delay spacing between successive signals in the series are each greater than 5 milliseconds and less than 80 milliseconds.

3. An audio system according to claim 2 in which the delay interval for the first delayed audio signal is approximately 30 milliseconds.

4. An audio system according to claim 2 in which the relative gains for the additive combination of the primary audio signal, the first delayed audio signal, and the second delayed audio signal in the summing circuit correspond approximately to the ratio 1:2:1, with the phase of the second delayed audio signal reversed relative to the phase of the primary audio signal.

5. An audio system according to claim 1 in which the delay means comprises:

analog-digital converter means for converting the primary audio signal to digital form;

and shift register means for delaying the digital primary audio signal by the specified delay intervals to develop the series of delayed audio signals in digital form;

the transversal filter means further including digital-analog converter means for effectively converting the spatial effect audio signal to analog form.

6. An audio system according to claim 5 in which the digital-analog converter means comprises a plurality of digital-analog converters, one for each of the delayed audio signals, respectively, with the digital-analog converters being incorporated in the delay means, ahead of the summing circuit.

7. An audio system according to claim 6 in which the analog-digital converter means comprises a delta modulator, and in which the delay means further comprises a compressor circuit in the input to the delta modulator, and a plurality of expander circuits, one for each of the delayed audio signals, connected in the outputs of the first and second digital-analog converters, respectively.

8. An audio system according to claim 7 in which the relative gains for the additive combination of the primary audio signal, the first delayed audio signal, and the second delayed audio signal in the summing circuit correspond approximately to the ratio 1:2:1, with the phase of the second delayed audio signal reversed relative to the phase of the primary audio signal.

9. A stereophonic audio system comprising:

an audio signal source for developing a first primary audio signal and a second primary audio signal, the two primary audio signals being sterophonically related to each other;

first and second primary audio transducers positioned in spaced relation to each other within a listening space;

a secondary audio transducer positioned within the listening space but spaced from the primary audio transducers;

primary transmission means, coupling the audio signal source to the primary transducers, for applying the first primary audio signal to the first primary transducer for reproduction, and for applying the second primary audio signal to the second primary transducer for reproduction;

and secondary transmission means, coupling the audio signal source to the secondary transducer for developing a spatial effect audio signal and applying to spatial effect audio signal to the secondary transducer for reproduction, the secondary transmission means comprising:

first summing circuit means for additively combining the primary audio signals to develop a monophonic intermediate audio signal;

and non-recursive transversal filter means having a finite impulse response, including:

delay means for developing a series of at least two delayed audio signals each corresponding to the intermediate audio signal but each delayed by a successively longer fixed delay interval with the delay interval for the first signal in the series and the delay spacing between successive signals in the series being of uniform duration, and second summing circuit means for additively combining the delayed audio signals and the intermediate audio signal in predetermined amplitude ratio and predetermined phase relationship to develop a spatial effect audio signal having a relatively flat amplitude-frequency characteristic over a broad band of frequencies and a delay-frequency characteristic exhibiting relatively even delay distribution over that band of frequencies.

10. An audio system according to claim 9 in which the delay interval for the first signal in the series is greater than five milliseconds and less than 80 milliseconds.

11. An audio system according to claim 10 in which the delay interval for the first signal in the series is approximately 30 milliseconds.

12. An audio system according to claim 10 in which the relative gains for the additive combination of the intermediate audio signal, the first delayed audio signal, and the second delayed audio signal in the second summing circuit means correspond approximately to the ratio 1:2:1, with the phase of the second delayed audio signal reversed relative to the phase of the primary audio signal.

13. An audio system according to claim 10 in which the delay means comprises:

analog-digital converter means for converting the intermediate audio signal to digital form;

and shift register means for delaying the digital intermediate audio signal by the specified delay intervals to develop the series of delayed audio signals in digital form;

the transversal filter means further including digital-analog converter means for effectively converting the spatial effect audio signal to analog form.

14. An audio system according to claim 13 in which the digital-analog converter means comprises a plurality of digital-analog converters, one for each of the delayed audio signals, respectively, with the digital-analog converters being incorporated in the delay means, ahead of the second summing circuit means.

15. An audio system according to claim 14 in which the analog-digital converter means comprises a delta modulator, and in which the delay means further comprises a compressor circuit in the input to the delta modulator, and a plurality of expander circuits, one for each of the delayed audio signals, connected in the outputs of the first and second digital-analog converters, respectively.

16. An audio system according to claim 15 in which the relative gains for the additive combination of the intermediate audio signal, the first delayed audio signal, and the second delayed audio signal in the second summing circuit means correspond approximately to the ratio 1:2:1, with the phase of the second delayed audio signal reversed relative to the phase of the primary audio signal.

17. A non-recursive audio transversal filter for generating a spatial effect audio signal from a primary audio signal compressing:

delay means for developing a series of at least two delayed audio signals each corresponding to the primary audio signal but each delayed by a successively longer delay interval, in which the delay spacing between successive signals in the series of delayed audio signals is uniform, and the delay spacing between successive signals in the series does not exceed about 100 milliseconds;

and summing circuit means for additively combining the primary audio signal and the delayed audio signals in predetermined amplitude ratio and predetermined phase relationship to develop a spatial effect audio signal having a relatively flat amplitude-frequency characteristic over a broad band of frequencies and a delay-frequency characteristic with relatively uniform delay distribution and small frequency spacing over that range of frequencies.

18. A non-recursive audio transversal filter, according to claim 17, in which the series of delayed audio signals constitutes just two signals, in which the relative gains for the additive combination of the primary, first delayed, and second delayed signals in the summing circuit means correspond approximately to the ratio 1:2:1, with the phase of the primary and second delayed signals reversed in phase relative to each other.

* * * * *